US008354214B2

(12) United States Patent
Vanbesien et al.

(10) Patent No.: US 8,354,214 B2
(45) Date of Patent: Jan. 15, 2013

(54) COATED CARRIERS

(75) Inventors: Daryl W. Vanbesien, Burlington (CA); Michael S. Hawkins, Cambridge (CA); Suxia Yang, Mississauga (CA); Richard P. N. Veregin, Mississauga (CA); Karen Ann Moffat, Brantford (CA)

(73) Assignee: Xerox Corporation, Norwalk, CT (US)

( * ) Notice: Subject to any disclaimer, the term of this patent is extended or adjusted under 35 U.S.C. 154(b) by 451 days.

(21) Appl. No.: 12/563,385

(22) Filed: Sep. 21, 2009

(65) Prior Publication Data

US 2011/0070538 A1 Mar. 24, 2011

(51) Int. Cl.
*G03G 9/00* (2006.01)

(52) U.S. Cl. ..... 430/111.35; 430/106.2; 430/111.32; 430/111.41; 430/137.13

(58) Field of Classification Search ..... 430/111.32, 430/111.35, 111.41, 106.2, 137.13
See application file for complete search history.

(56) References Cited

U.S. PATENT DOCUMENTS

| | | | |
|---|---|---|---|
| 3,590,000 | A | 6/1971 | Palermiti et al. |
| 3,800,588 | A | 4/1974 | Larson et al. |
| 4,298,672 | A | 11/1981 | Lu |
| 4,338,390 | A | 7/1982 | Lu |
| 4,935,326 | A | 6/1990 | Creatura et al. |
| 4,937,166 | A | 6/1990 | Creatura et al. |
| 5,290,654 | A | 3/1994 | Sacripante et al. |
| 5,302,486 | A | 4/1994 | Patel et al. |
| 5,631,116 | A | 5/1997 | Uchida et al. |
| 6,042,981 | A | 3/2000 | Barbetta et al. |
| 6,063,827 | A | 5/2000 | Sacripante et al. |
| 6,120,967 | A | 9/2000 | Hopper et al. |
| 6,214,507 | B1 | 4/2001 | Sokol et al. |
| 6,335,138 | B1 | 1/2002 | Kurose et al. |
| 6,355,391 | B1 | 3/2002 | Van Dusen et al. |
| 6,511,780 | B1 | 1/2003 | Veregin et al. |
| 6,593,049 | B1 | 7/2003 | Veregin et al. |
| 6,756,176 | B2 | 6/2004 | Stegamat et al. |
| 6,830,860 | B2 | 12/2004 | Sacripante et al. |
| 7,014,971 | B2 | 3/2006 | Skorokhod et al. |
| 7,419,755 | B2 | 9/2008 | Maniar et al. |
| 7,435,522 | B2 | 10/2008 | Maniar et al. |
| 7,452,651 | B2 | 11/2008 | Hotta et al. |
| 2002/0081514 | A1 | 6/2002 | Ohba et al. |
| 2003/0004954 | A1 | 1/2003 | Clark |
| 2006/0166125 | A1 | 7/2006 | Skorokhod et al. |
| 2008/0056769 | A1* | 3/2008 | Iizuka et al. ..... 399/252 |
| 2008/0166647 | A1 | 7/2008 | Mang |
| 2009/0111042 | A1 | 4/2009 | Kiyono |

FOREIGN PATENT DOCUMENTS

| | | |
|---|---|---|
| JP | 2004-301910 | 10/2004 |
| JP | 2008-122444 | 5/2008 |

* cited by examiner

*Primary Examiner* — Thorl Chea
(74) *Attorney, Agent, or Firm* — MDIP LLC

(57) ABSTRACT

The present disclosure provides carriers for use with toner compositions. In embodiments, a carrier may include a core, having a dry powder polymer coating. In embodiments, the coating may also include a colorant, such as carbon black. Processes for coating such carriers with the dry powder polymer coatings are also provided.

20 Claims, 6 Drawing Sheets

COATED CARRIERS

BACKGROUND

The present disclosure is generally directed to toner compositions, and more specifically, to toner compositions including coated carrier components. In embodiments, the coated carrier particles can be prepared with polymeric components utilizing dry powder processes.

Electrophotographic printing utilizes toner particles which may be produced by a variety of processes. One such process includes an emulsion aggregation ("EA") process that forms toner particles in which surfactants are used in forming a latex emulsion. See, for example, U.S. Pat. No. 6,120,967, the disclosure of which is hereby incorporated by reference in its entirety, as one example of such a process.

Combinations of amorphous and crystalline polyesters may be used in the EA process. This resin combination may provide toners with high gloss and relatively low-melting point characteristics (sometimes referred to as low-melt, ultra low melt, or ULM), which allows for more energy efficient and faster printing. The use of additives with EA toner particles may be important in realizing optimal toner performance, especially in the area of charging, where crystalline polyesters on the particle surface can lead to poor A-zone charge.

There is a continual need for improving the use of polyesters and additives in the formation of EA ULM toners.

SUMMARY

The present disclosure provides carriers suitable for use in developers, as well as processes for producing same. In embodiments, a carrier of the present disclosure includes a core, and a polymeric coating over at least a portion of a surface of the core, the polymeric coating including a copolymer derived from monomers such as an aliphatic cycloacrylate and optionally a dialklyaminoacrylate, and optionally carbon black, wherein the polymeric resin coating is applied to the carrier as particles of size from about 40 nm to about 200 nm in diameter, and wherein those particles are fused to the surface of the carrier core by heating.

In embodiments, a developer of the present disclosure includes a toner including at least one resin and one or more optional ingredients such as optional colorants, optional waxes, and combinations thereof, and a carrier including a core and a polymeric coating over at least a portion of a surface of the core, the polymeric coating including a copolymer derived from monomers such as an aliphatic cycloacrylate, optionally a dialklyaminoacrylate, and optionally carbon black.

A process of the present disclosure may include, in embodiments, forming an emulsion including at least one surfactant, an aliphatic cycloacrylate, a dialklyaminoacrylate, and optionally carbon black, polymerizing the aliphatic cycloacrylate and the dialklyaminoacrylate to form a copolymer resin, recovering the copolymer resin, drying the copolymer resin to form a powder coating, and applying the powder coating to a core.

BRIEF DESCRIPTION OF THE DRAWINGS

Various embodiments of the present disclosure will be described herein below with reference to the figures wherein.

DETAILED DESCRIPTION

Figure 1:
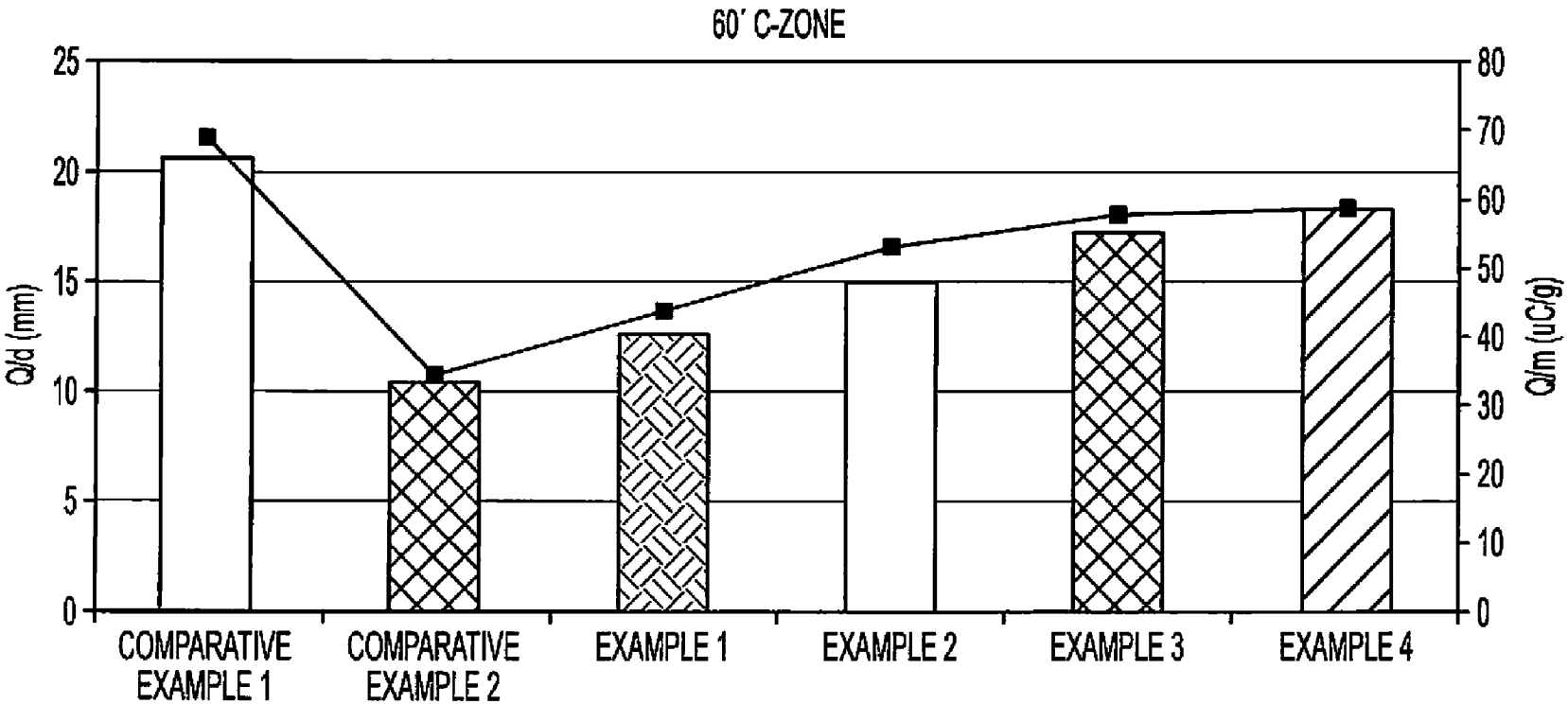
FIG. 1 is a graph showing the 60 minute C-zone charging characteristics for toners of the present disclosure.

In embodiments, the present disclosure provides carrier particles which include a core, in embodiments a core metal, with a coating thereover. The coating may include a polymer, optionally in combination with a colorant such as carbon black.

Carrier

Various suitable solid core materials can be utilized for the carriers and developers of the present disclosure. Characteristic core properties include those that, in embodiments, will enable the toner particles to acquire a positive charge or a negative charge, and carrier cores that will permit desirable flow properties in the developer reservoir present in an electrophotographic imaging apparatus. Other desirable properties of the core include, for example, suitable magnetic characteristics that permit magnetic brush formation in magnetic brush development processes; desirable mechanical aging characteristics; and desirable surface morphology to permit high electrical conductivity of any developer including the carrier and a suitable toner.

Examples of carrier cores that can be utilized include iron and/or steel, such as atomized iron or steel powders available from Hoeganaes Corporation or Pomaton S.p.A (Italy); ferrites such as Cu/Zn-ferrite containing, for example, about 11 percent copper oxide, about 19 percent zinc oxide, and about 70 percent iron oxide, including those commercially available from D.M. Steward Corporation or Powdertech Corporation, Ni/Zn-ferrite available from Powdertech Corporation, Sr (strontium)-ferrite, containing, for example, about 14 percent strontium oxide and about 86 percent iron oxide, commercially available from Powdertech Corporation, and Ba-ferrite; magnetites, including those commercially available from, for example, Hoeganaes Corporation (Sweden); nickel; combinations thereof, and the like. In embodiments, the polymer particles obtained can be used to coat carrier cores of any known type by a number of methods, such as various known methods, and which carriers are then incorporated with a known toner to form a developer for electrophotographic printing. Other suitable carriers cores are illustrated in, for example, U.S. Pat. Nos. 4,937,166, 4,935,326, and 7,014,971, the disclosures of each of which are hereby incorporated by reference in their entirety, and may include granular zircon, granular silicon, glass, silicon dioxide, combinations thereof, and the like. In embodiments, suitable carrier cores may have an average particle size of, for example, from about 20 microns to about 400 microns in diameter, in embodiments from about 40 microns to about 200 microns in diameter.

The polymeric coating on the core metal includes a latex. In embodiments, a latex copolymer utilized as the coating of a carrier core may be derived from monomers including an aliphatic cycloacrylate and a dialklyaminoacrylate, in embodiments a dialkylamino alkylmethacrylate, and optionally carbon black. Suitable aliphatic cycloacrylates which may be utilized in forming the polymer coating include, for example, cyclohexylmethacrylate, cyclopropyl acrylate, cyclobutyl acrylate, cyclopentyl acrylate, cyclohexyl acrylate, cyclopropyl methacrylate, cyclobutyl methacrylate, cyclopentyl methacrylate, combinations thereof, and the like. Suitable dialkylaminoacrylates which may be utilized in forming the polymer coating include, for example, dimethylamino ethyl methacrylate (DMAEMA), 2-(dimethylamino) ethyl methacrylate, diethylamino ethyl methacrylate, dimethylamino butyl methacrylate, methylamino ethyl methacrylate, combinations thereof, and the like.

The cycloacrylate may be present in a copolymer utilized as a polymeric coating of a carrier core in an amount of from about 85% by weight of the copolymer to about 99% by weight of the copolymer, in embodiments from about 90% by weight of the copolymer to about 97% by weight of the copolymer. The dialkylaminoacrylate may be present in such a copolymer in an amount of from about 0.01% by weight of the copolymer to about 5% by weight of the copolymer.

Where the cycloacrylate is cyclohexylmethacrylate and the dialklyaminoacrylate is 2-(dimethylamino) ethyl methacrylate, the resulting copolymer utilized as the coating of a carrier core may be a polycyclomethacrylate-co-2-(dimethyl amino)ethylmethacrylate.

Methods for forming the polymeric coating are within the purview of those skilled in the art and include, in embodiments, emulsion polymerization of the monomers utilized to form the polymeric coating.

In the polymerization process, the reactants may be added to a suitable reactor, such as a mixing vessel. The appropriate amount of starting materials may be optionally dissolved in a solvent, an optional initiator may be added to the solution, and contacted with at least one surfactant to form an emulsion. A copolymer may be formed in the emulsion, which may then be recovered and used as the polymeric coating for a carrier particle.

Where utilized, suitable solvents include, but are not limited to, water and/or organic solvents including toluene, benzene, xylene, tetrahydrofuran, acetone, acetonitrile, carbon tetrachloride, chlorobenzene, cyclohexane, diethyl ether, dimethyl ether, dimethyl formamide, heptane, hexane, methylene chloride, pentane, combinations thereof, and the like.

In embodiments, the latex for forming the polymeric coating may be prepared in an aqueous phase containing a surfactant or co-surfactant, optionally under an inert gas such as nitrogen. Surfactants which may be utilized with the resin to form a latex dispersion can be ionic or nonionic surfactants in an amount of from about 0.01 to about 15 weight percent of the solids, and in embodiments of from about 0.1 to about 10 weight percent of the solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like. In embodiments a suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxylethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, combinations thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO290™, IGEPAL CA-210™, ANTAROX890™ and ANTAROX897™ can be utilized.

The choice of particular surfactants or combinations thereof, as well as the amounts of each to be used, are within the purview of those skilled in the art.

In embodiments initiators may be added for formation of the latex utilized in formation of the polymeric coating. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine)dihydrochloride, 2,2'-azobis[N-(4-chlorophenyl)-2-methylpropionamidine]di-hydrochloride, 2,2'-azobis[N-(4-hydroxyphenyl)-2-methyl-propionamidine]dihydrochloride, 2,2'-azobis[N-(4-amino-phenyl)-2-methylpropionamidine] tetrahydrochloride, 2,2'-azobis[2-methyl-N(phenylmethyl) propionamidine]dihydrochloride, 2,2'-azobis[2-methyl-N-2-propenylpropionamidine]dihydrochloride, 2,2'-azobis[N-(2-hydroxy-ethyl)-2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane]dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis {2-[1-(2-hydroxyethyl)-2-imidazolin-2-yl]propane}dihydrochloride, combinations thereof, and the like.

Initiators can be added in suitable amounts, such as from about 0.1 to about 8 weight percent, and in embodiments of from about 0.2 to about 5 weight percent of the monomers.

In forming the emulsions, the starting materials, surfactant, optional solvent, and optional initiator may be combined utilizing any means within the purview of those skilled in the art. In embodiments, the reaction mixture may be mixed for from about 1 minute to about 72 hours, in embodiments from about 4 hours to about 24 hours, while keeping the temperature at from about 10° C. to about 100° C., in embodiments from about 20° C. to about 90° C., in other embodiments from about 45° C. to about 75° C.

The coating materials may be particles. The size of the particles utilized to coat the carrier may be from about 40 nm to about 200 nm in diameter, in embodiments from about 60 nm to about 150 nm in diameter. In embodiments, the coating materials may be fused to the surface of the carrier by heating to a suitable temperature, in embodiments from about 170° C. to about 280° C., in embodiments from about 190° C. to about 240° C.

Those skilled in the art will recognize that optimization of reaction conditions, temperature, and initiator loading can be varied to generate polyesters of various molecular weights, and that structurally related starting materials may be polymerized using comparable techniques.

Once the copolymer utilized as the coating for a carrier has been formed, it may be recovered from the emulsion by any technique within the purview of those skilled in the art, including filtration, drying, centrifugation, spray drying, combinations thereof, and the like.

In embodiments, once obtained, the copolymer utilized as the coating for a carrier may be dried to powder form by any method within the purview of those skilled in the art, including, for example, freeze drying, optionally in a vacuum, spray drying, combinations thereof, and the like.

Particles of the copolymer may have a size of from about 40 nanometers to about 200 nanometers, in embodiments from about 60 nanometers to about 120 nanometers, although sizes outside these ranges may be obtained.

In embodiments, if the size of the particles of the dried polymeric coating is too large, the particles may be subjected to homogenizing or sonication to further disperse the particles and break apart any agglomerates or loosely bound particles, thereby obtaining particles of the sizes noted above. Where utilized, a homogenizer (that is, a high shear device), may operate at a rate of from about 6,000 rpm to about 10,000 rpm, in embodiments from about 7,000 rpm to about 9,750 rpm, for a period of time of from about 0.5 minutes to about 60 minutes, in embodiments from about 5 minute to about 30 minutes.

The copolymers utilized as the carrier coating may have a number average molecular weight ($M_n$), as measured by gel permeation chromatography (GPC) of, for example, from about 60,000 to about 400,000, in embodiments from about 170,000 to about 280,000, and a weight average molecular weight ($M_w$) of, for example, from about 200,000 to about 800,000, in embodiments from about 400,000 to about 600,000, as determined by Gel Permeation Chromatography using polystyrene standards.

The copolymers utilized as the carrier coating may have a glass transition temperature (Tg) of from about 85° C. to about 140° C., in embodiments from about 100° C. to about 130° C., although values outside these ranges may be obtained.

In some embodiments, the carrier coating may include a conductive component. Suitable conductive components include, for example, carbon black.

There may be added to the carrier a number of additives, for example charge enhancing additives, such as particulate amine resins, such as melamine, and certain fluoropolymer powders, such as alkyl-amino acrylates and methacrylates, polyamides, and fluorinated polymers, such as polyvinylidine fluoride and poly(tetrafluoroethylene), and fluoroalkyl methacrylates, such as 2,2,2-trifluoroethyl methacrylate. Other charge enhancing additives which may be included are quaternary ammonium salts, including distearyl dimethyl ammonium methyl sulfate (DDAMS), bis[1-[(3,5-disubstituted-2-hydroxyphenyl)azo]-3-(mono-substituted)-2-naphthalenolato(2-)]chromate(1-), ammonium sodium and hydrogen (TRH), cetyl pyridinium chloride (CPC), FANAL PINK® D4830, combinations thereof, and the like, and other effective known charge agents or additives. The charge additive components may be selected in various effective amounts, such as from about 0.5 weight percent to about 20 weight percent, and from about 1 weight percent to about 3 weight percent, based, for example, on the sum of the weights of polymer, conductive component, and other charge additive components. The addition of conductive components can act to further increase the negative triboelectric charge imparted to the carrier, and therefore, further increase the negative triboelectric charge imparted to the toner in, for example, a electrophotographic development subsystem. These components may be included by roll mixing, tumbling, milling, shaking, electrostatic powder cloud spraying, fluidized bed, electrostatic disc processing, and an electrostatic curtain, as described, for example, in U.S. Pat. No. 6,042,981, the disclosure of which is hereby incorporated by reference in its entirety, and wherein the carrier coating is fused to the carrier core in either a rotary kiln or by passing through a heated extruder apparatus. Conductivity is important for semi-conductive magnetic brush development to enable good development of solid areas which otherwise may be weakly developed.

It has been found that the addition of the polymeric coating of the present disclosure, optionally with a conductive component such as carbon black, can result in carriers with decreased developer triboelectric response with change relative humidities of from about 20 percent to about 90 percent, in embodiments from about 40 percent to about 80 percent, that the charge is more consistent when the relative humidity is changed, and thus there is less decrease in charge at high relative humidity reducing background toner on the prints, and less increase in charge and subsequently less loss of development at low relative humidity, resulting in such improved image quality performance due to improved optical density.

As noted above, in embodiments the polymeric coating may be dried, after which time it may be applied to the core carrier as a dry powder. Powder coating processes differ from conventional solution coating processes. Solution coating requires a coating polymer whose composition and molecular weight properties enable the resin to be soluble in a solvent in the coating process. This typically requires relatively low Mw compared to powder coating, which does not provide the most robust coating. The powder coating process does not require solvent solubility, but does require the resin to be coated as a particulate with a particle size of about 10 nm to about 2 micron, or about 30 nm to 1 micron, or about 50 nm to 400 nm.

Examples of processes which may be utilized to apply the powder coating include, for example, combining the carrier core material and copolymer coating by cascade roll mixing, tumbling, milling, shaking, electrostatic powder cloud spraying, fluidized bed, electrostatic disc processing, electrostatic curtains, combinations thereof, and the like. When resin coated carrier particles are prepared by a powder coating process, the majority of the coating materials may be fused to the carrier surface thereby reducing the number of toner impaction sites on the carrier. Fusing of the polymeric coating may occur by mechanical impaction, electrostatic attraction, combinations thereof, and the like.

Following application of the copolymers to the core, heating may be initiated to permit flow of the coating material over the surface of the carrier core. The concentration of the coating material powder particles, and the parameters of the heating may be selected to enable the formation of a continuous film of the coating polymers on the surface of the carrier core, or permit only selected areas of the carrier core to be coated. In embodiments, the carrier with the polymeric powder coating may be heated to a temperature of from about 170° C. to about 280° C., in embodiments from about 190° C. to about 240° C., for a period of time of, for example, from about 10 minutes to about 180 minutes, in embodiments from about 15 minutes to about 60 minutes, to enable the polymer coating to melt and fuse to the carrier core particles. Following incorporation of the micro-powder onto the surface of the carrier, heating may be initiated to permit flow of the coating material over the surface of the carrier core. In embodiments, the micro-powder is fused to the carrier core in either a rotary kiln or by passing through a heated extruder apparatus. See, for example, U.S. Pat. No. 6,355,391, the disclosure of which is hereby incorporated by reference in its entirety.

In embodiments, the coating coverage encompasses from about 10 percent to about 100 percent of the carrier core. When selected areas of the metal carrier core remain uncoated or exposed, the carrier particles may possess electrically conductive properties when the core material is a metal.

The coated carrier particles may then be cooled, in embodiments to room temperature, and recovered for use in forming toners.

In embodiments, carriers of the present disclosure may include a core, in embodiments a ferrite core, having a size of from about 20 μm to about 100 μm, in embodiments from about 30 μm to about 75 μm (although sizes outside of these ranges may be used), coated with about 0.5% to about 10% by weight, in embodiments from about 0.7% to about 5% by weight (although amounts outside of these ranges may be obtained), of the polymer coating of the present disclosure, optionally including carbon black.

Thus, with the carrier compositions and processes of the present disclosure, there can be formulated developers with selected high triboelectric charging characteristics and/or conductivity values utilizing a number of different combinations.

Toners

The coated carriers thus produced may then be combined with toner resins, optionally possessing colorants, to form a toner of the present disclosure.

Any latex resin may be utilized in forming a toner of the present disclosure. Such resins, in turn, may be made of any suitable monomer. Any monomer employed may be selected depending upon the particular polymer to be utilized.

In embodiments, the resins may be an amorphous resin, a crystalline resin, and/or a combination thereof. In further embodiments, the polymer utilized to form the resin may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol may be, for example, selected in an amount of from about 40 to about 60 mole percent, in embodiments from about 42 to about 55 mole percent, in embodiments from about 45 to about 53 mole percent (although amounts outside of these ranges can be used), and the alkali sulfo-aliphatic diol can be selected in an amount of from about 0 to about 10 mole percent, in embodiments from about 1 to about 4 mole percent of the resin (although amounts outside of these ranges can be used).

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid may be selected in an amount of, for example, in embodiments from about 40 to about 60 mole percent, in embodiments from about 42 to about 52 mole percent, in embodiments from about 45 to about 50 mole percent (although amounts outside of these ranges can be used), and the alkali sulfo-aliphatic diacid can be selected in an amount of from about 1 to about 10 mole percent of the resin (although amounts outside of these ranges can be used).

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylenesebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), alkali copoly(5-sulfoisophthaloyl)-copoly(ethylene-adipate), alkali copoly (5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly (propylene-adipate), alkali copoly(5-sulfo-isophthaloyl)-copoly(butylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly (pentylene-succinate), alkali copoly(5-sulfoisophthaloyl)-copoly(hexylene-succinate), alkali copoly(5-sulfoisophthaloyl)-copoly(octylene-succinate), alkali copoly (5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly (octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly (5-sulfo-isophthaloyl)-copoly(pentylene-adipate), alkali copoly(5-sulfo-isophthaloyl)-copoly(hexylene-adipate), poly(octylene-adipate), wherein alkali is a metal like sodium, lithium or potassium. Examples of polyamides include poly (ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

The crystalline resin may be present, for example, in an amount of from about 5 to about 50 percent by weight of the toner components, in embodiments from about 10 to about 35 percent by weight of the toner components (although amounts outside of these ranges can be used). The crystalline resin can possess various melting points of, for example, from about 30° C. to about 120° C., in embodiments from about 50° C. to about 90° C. (although melting points outside of these ranges can be obtained). The crystalline resin may have a number average molecular weight ($M_n$), as measured by gel permeation chromatography (GPC) of, for example, from about 1,000 to about 50,000, in embodiments from about 2,000 to about 25,000 (although number average molecular weights outside of these ranges can be obtained), and a weight average molecular weight ($M_w$) of, for example, from about 2,000 to about 100,000, in embodiments from about 3,000 to about 80,000 (although weight average molecular weights outside of these ranges can be obtained), as determined by Gel Permeation Chromatography using polystyrene standards. The molecular weight distribution ($M_w/M_n$) of the crystalline resin may be, for example, from about 2 to about 6, in embodiments from about 3 to about 4 (although molecular weight distributions outside of these ranges can be obtained).

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin (although amounts outside of these ranges can be used).

Examples of the alkylene oxide adducts of bisphenol include polyoxypropylene (2.2)-2,2-bis(4-hydroxyphenyl) propane, polyoxypropylene (3.3)-2,2-bis(4-hydroxyphenyl) propane, polyoxyethylene (2.0)-2,2-bis(4-hydroxyphenyl) propane, polyoxyethylene (2.2)-2,2-bis(4-hydroxyphenyl) propane, polyoxypropylene (2.0)-polyoxyethylene (2.0)-2,2-bis(4-hydroxyphenyl)propane, and polyoxypropylene (6)-2,2-bis(4-hydroxyphenyl)propane. These compounds may be used singly or as a combination of two or more thereof. Examples of additional diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, 1,4-cyclohexanedimethanol, 1,3-cyclohexanedimethanol, xylenedimethanol, cyclohexanediol, diethylene glycol, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin (although amounts outside of these ranges can be used).

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin (although amounts outside of this range can be used).

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

Furthermore, in embodiments, a crystalline polyester resin may be contained in the binding resin. The crystalline polyester resin may be synthesized from an acid (dicarboxylic acid) component and an alcohol (diol) component. In what follows, an "acid-derived component" indicates a constituent moiety that was originally an acid component before the synthesis of a polyester resin and an "alcohol-derived component" indicates a constituent moiety that was originally an alcoholic component before the synthesis of the polyester resin.

A "crystalline polyester resin" indicates one that shows not a stepwise endothermic amount variation but a clear endothermic peak in differential scanning calorimetry (DSC). However, a polymer obtained by copolymerizing the crystalline polyester main chain and at least one other component is also called a crystalline polyester if the amount of the other component is 50% by weight or less.

As the acid-derived component, an aliphatic dicarboxylic acid may be utilized, such as a straight chain carboxylic acid. Examples of straight chain carboxylic acids include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,1-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, as well as lower alkyl esters and acid anhydrides thereof. Among these, acids having 6 to 10 carbon atoms may be desirable for obtaining suitable crystal melting point and charging properties. In order to improve the crystallinity, the straight chain carboxylic acid may be present in an amount of about 95% by mole or more of the acid component and, in embodiments, more than about 98% by mole of the acid component.

Other acids are not particularly restricted, and examples thereof include conventionally known divalent carboxylic acids and dihydric alcohols, for example those described in "Polymer Data Handbook Basic Edition" (Soc. Polymer Science, Japan Ed.: Baihukan). Specific examples of the monomer components include, as divalent carboxylic acids, dibasic acids such as phthalic acid, isophthalic acid, terephthalic acid, naphthalene-2,6-dicarboxylic acid, naphthalene-2,7-dicarboxylic acid, and cyclohexanedicarboxylic acid, and anhydrides and lower alkyl esters thereof, as well as combinations thereof, and the like.

As the acid-derived component, a component such as a dicarboxylic acid-derived component having a sulfonic acid group may also be utilized.

The dicarboxylic acid having a sulfonic acid group may be effective for obtaining excellent dispersion of a coloring agent such as a pigment. Furthermore, when a whole resin is emulsified or suspended in water to prepare a toner mother particle, a sulfonic acid group, may enable the resin to be emulsified or suspended without a surfactant. Examples of such dicarboxylic acids having a sulfonic group include, but are not limited to, sodium 2-sulfoterephthalate, sodium 5-sulfoisophthalate and sodium sulfosuccinate. Furthermore, lower alkyl esters and acid anhydrides of such dicarboxylic acids having a sulfonic group, for example, are also usable. Among these, sodium 5-sulfoisophthalate and the like may be desirable in view of the cost. The content of the dicarboxylic acid having a sulfonic acid group may be from about 0.1% by mole to about 2% by mole, in embodiments from about 0.2% by mole to about 1% by mole. When the content is more than about 2% by mole, the charging properties may be deteriorated. Here, "component mol %" or "component mole %" indicates the percentage when the total amount of each of the components (acid-derived component and alcohol-derived component) in the polyester resin is assumed to be 1 unit (mole).

As the alcohol component, aliphatic dialcohols may be used. Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol and 1,20-eicosanediol. Among them, those having from about 6 to about 10 carbon atoms may be used to obtain desirable crystal melting points and charging properties. In order to raise crystallinity, it may be useful to use the straight chain dialcohols in an amount of about 95% by mole or more, in embodiments about 98% by mole or more.

Examples of other dihydric dialcohols which may be utilized include bisphenol A, hydrogenated bisphenol A, bisphenol A ethylene oxide adduct, bisphenol A propylene oxide adduct, 1,4-cyclohexanediol, 1,4-cyclohexanedimethanol, diethylene glycol, propylene glycol, dipropylene glycol, 1,3-butanediol, neopentyl glycol, combinations thereof, and the like.

For adjusting the acid number and hydroxyl number, the following may be used: monovalent acids such as acetic acid and benzoic acid; monohydric alcohols such as cyclohexanol and benzyl alcohol; benzenetricarboxylic acid, naphthalenetricarboxylic acid, and anhydrides and lower alkylesters thereof; trivalent alcohols such as glycerin, trimethylolethane, trimethylolpropane, pentaerythritol, combinations thereof, and the like.

The crystalline polyester resins may be synthesized from a combination of components selected from the above-mentioned monomer components, by using conventional known methods. Exemplary methods include the ester exchange method and the direct polycondensation method, which may be used singularly or in a combination thereof. The molar ratio (acid component/alcohol component) when the acid component and alcohol component are reacted, may vary depending on the reaction conditions. The molar ratio is usually about 1/1 in direct polycondensation. In the ester exchange method, a monomer such as ethylene glycol, neopentyl glycol or cyclohexanedimethanol, which may be distilled away under vacuum, may be used in excess.

Examples of other suitable resins or polymers which may be utilized include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly (styrene-butyl acrylate-methacrylic acid), poly(styrene-butyl acrylate-acrylonitrile), and poly(styrene-butyl acrylate-acrylonitrile-acrylic acid), and combinations thereof. The polymer may be block, random, or alternating copolymers.

In embodiments, the resins may have a glass transition temperature of from about 30° C. to about 80° C., in embodiments from about 35° C. to about 70° C. In further embodiments, the resins utilized in the toner may have a melt viscosity of from about 10 to about 1,000,000 Pa*S at about 130° C., in embodiments from about 20 to about 100,000 Pa*S.

One, two, or more toner resins may be used. In embodiments where two or more toner resins are used, the toner resins may be in any suitable ratio (e.g., weight ratio) such as for instance about 10% (first resin)/90% (second resin) to about 90% (first resin)/10% (second resin).

In embodiments, the resin may be formed by emulsion polymerization methods.

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Any surfactant described above for use in forming the copolymer utilized as the polymeric coating for the carrier core may be utilized.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner, although amounts outside these ranges may be utilized.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI-60710, CI Dispersed Red 15, diazo dye identified in the Color Index as CI-26050, CI Solvent Red 19, and the like. Illustrative examples of cyans include copper tetra(octadecyl sulfonamido) phthalocyanine, x-copper phthalocyanine pigment listed in the Color Index as CI-74160, CI Pigment Blue, Pigment Blue 15:3, and Anthrathrene Blue, identified in the Color Index as CI-69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and optional colorant in forming toner particles. When included, the wax may be present in an amount of, for example, from about 1 weight percent to about 25 weight percent of the toner particles, in embodiments from about 5 weight percent to about 20 weight percent of the toner particles, although amounts outside these ranges may be utilized.

Waxes that may be selected include waxes having, for example, a weight average molecular weight of from about 500 to about 20,000, in embodiments from about 1,000 to about 10,000, although molecular weights outside these ranges may be utilized. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™ POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner particle shape and morphology.

In embodiments, toner compositions may be prepared by emulsion-aggregation processes, such as a process that includes aggregating a mixture of an optional colorant, an optional wax and any other desired or required additives, and emulsions including the resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 4 to about 5, although a pH outside this range may be utilized. Additionally, in embodiments, the mixture may be homogenized. If the mixture is homogenized, homogenization may be accomplished by mixing at about 600 to about 4,000 revolutions per minute, although speeds outside this range may be utilized. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture, although amounts outside these ranges may be utilized. This provides a sufficient amount of agent for aggregation.

In order to control aggregation and subsequent coalescence of the particles, in embodiments the aggregating agent may be metered into the mixture over time. For example, the agent may be metered into the mixture over a period of from about 5 to about 240 minutes, in embodiments from about 30 to about 200 minutes, although more or less time may be used as desired or required. The addition of the agent may also be done while the mixture is maintained under stirred conditions, in embodiments from about 50 rpm to about 1,000 rpm, in other embodiments from about 100 rpm to about 500 rpm, although speeds outside these ranges may be utilized and at a temperature that is below the glass transition temperature of the resin as discussed above, in embodiments from about 30° C. to about 90° C., in embodiments from about 35° C. to about 70° C., although temperatures outside these ranges may be utilized.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 30° C. to about 99° C., and holding the mixture at this temperature for a time from about 0.5 hours to about 10 hours, in embodiments from about hour 1 to about 5 hours (although times outside these ranges may be utilized), while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C. (although temperatures outside these ranges may be utilized), which may be below the glass transition temperature of the resin as discussed above.

Once the desired final size of the toner particles is achieved, the pH of the mixture may be adjusted with a base to a value of from about 3 to about 10, and in embodiments from about 5 to about 9, although a pH outside these ranges may be utilized. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

In some embodiments, a resin, including any resin described above for use in forming the toner, may be applied to the toner particles to form a shell thereover.

Coalescence

Following aggregation to the desired particle size and application of any optional shell, the particles may then be coalesced to the desired final shape, the coalescence being achieved by, for example, heating the mixture to a temperature of from about 45° C. to about 100° C., in embodiments from about 55° C. to about 99° C. (although temperatures outside of these ranges may be used), which may be at or above the glass transition temperature of the resins utilized to form the toner particles, and/or reducing the stirring, for example to from about 100 rpm to about 1,000 rpm, in embodiments from about 200 rpm to about 800 rpm (although speeds outside of these ranges may be used). The fused particles can be measured for shape factor or circularity, such as with a Sysmex FPIA 2100 analyzer, until the desired shape is achieved.

Higher or lower temperatures may be used, it being understood that the temperature is a function of the resins used for the binder. Coalescence may be accomplished over a period of from about 0.01 to about 9 hours, in embodiments from about 0.1 to about 4 hours (although times outside of these ranges may be used).

After aggregation and/or coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

As noted above, the coated carriers of the present disclosure may be combined with these toner particles. In embodiments, the toner particles may also contain other optional additives, as desired or required. For example, the toner may include additional positive or negative charge control agents, for example in an amount of from about 0.1 to about 10 percent by weight of the toner, in embodiments from about 1 to about 3 percent by weight of the toner (although amounts outside of these ranges may be used). Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Orient Chemical Industries, Ltd.); combinations thereof, and the like. Such charge control agents may be applied simultaneously with the shell resin described above or after application of the shell resin.

There can also be blended with the toner particles external additive particles after formation including flow aid additives, which additives may be present on the surface of the toner particles. Examples of these additives include metal oxides such as titanium oxide, silicon oxide, aluminum oxides, cerium oxides, tin oxide, mixtures thereof, and the like; colloidal and amorphous silicas, such as AEROSIL®, metal salts and metal salts of fatty acids inclusive of zinc stearate, calcium stearate, or long chain alcohols such as UNILIN 700, and mixtures thereof.

In general, silica may be applied to the toner surface for toner flow, tribo enhancement, admix control, improved development and transfer stability, and higher toner blocking temperature. $TiO_2$ may be applied for improved relative humidity (RH) stability, tribo control and improved development and transfer stability. Zinc stearate, calcium stearate and/or magnesium stearate may optionally also be used as an external additive for providing lubricating properties, developer conductivity, tribo enhancement, enabling higher toner charge and charge stability by increasing the number of contacts between toner and carrier particles. In embodiments, a commercially available zinc stearate known as Zinc Stearate L, obtained from Ferro Corporation, may be used. The external surface additives may be used with or without a coating.

Each of these external additives may be present in an amount of from about 0.1 percent by weight to about 5 percent by weight of the toner, in embodiments of from about 0.25 percent by weight to about 3 percent by weight of the toner, although the amount of additives can be outside of these ranges. In embodiments, the toners may include, for example, from about 0.1 weight percent to about 5 weight percent titania, from about 0.1 weight percent to about 8 weight percent silica, and from about 0.1 weight percent to about 4 weight percent zinc stearate (although amounts outside of these ranges may be used).

Suitable additives include those disclosed in U.S. Pat. Nos. 3,590,000, 3,800,588, and 6,214,507, the disclosures of each of which are hereby incorporated by reference in their entirety. Again, these additives may be applied simultaneously with the shell resin described above or after application of the shell resin.

In embodiments, toners of the present disclosure may be utilized as ultra low melt (ULM) toners. In embodiments, the dry toner particles having a core and/or shell may, exclusive of external surface additives, have one or more the following characteristics:

(1) Volume average diameter (also referred to as "volume average particle diameter") was measured for the toner particle volume and diameter differentials. The toner particles have a volume average diameter of from about 3 to about 25 μm, in embodiments from about 4 to about 15 μm, in other embodiments from about 5 to about 12 μm (although values outside of these ranges may be obtained).

(2) Number Average Geometric Size Distribution (GSDn) and/or Volume Average Geometric Size Distribution (GSDv): In embodiments, the toner particles described in (1) above may have a very narrow particle size distribution with a lower number ratio GSD of from about 1.15 to about 1.38, in other embodiments, less than about 1.31 (although values outside of these ranges may be obtained). The toner particles of the present disclosure may also have a size such that the upper GSD by volume in the range of from about 1.20 to about 3.20, in other embodiments, from about 1.26 to about 3.11 (although values outside of these ranges may be obtained). Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

(3) Shape factor of from about 105 to about 170, in embodiments, from about 110 to about 160, SF1*a (although values outside of these ranges may be obtained). Scanning electron microscopy (SEM) may be used to determine the shape factor analysis of the toners by SEM and image analysis (IA). The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area.

(4) Circularity of from about 0.92 to about 0.99, in other embodiments, from about 0.94 to about 0.975 (although values outside of these ranges may be obtained). The instrument used to measure particle circularity may be an FPIA-2100 manufactured by Sysmex.

The characteristics of the toner particles may be determined by any suitable technique and apparatus and are not limited to the instruments and techniques indicated hereinabove.

In embodiments, the toner particles may have a weight average molecular weight (Mw) in the range of from about 17,000 to about 60,000 daltons, a number average molecular weight (Mn) of from about 9,000 to about 18,000 daltons, and a MWD (a ratio of the Mw to Mn of the toner particles, a measure of the polydispersity, or width, of the polymer) of from about 2.1 to about 10 (although values outside of these ranges may be obtained). For cyan and yellow toners, the toner particles in embodiments can exhibit a weight average molecular weight (Mw) of from about 22,000 to about 38,000 daltons, a number average molecular weight (Mn) of from about 9,000 to about 13,000 daltons, and a MWD of from about 2.2 to about 10 (although values outside of these ranges may be obtained). For black and magenta, the toner particles in embodiments can exhibit a weight average molecular weight (Mw) of from about 22,000 to about 38,000 daltons, a number average molecular weight (Mn) of from about 9,000 to about 13,000 daltons, and a MWD of from about 2.2 to about 10 (although values outside of these ranges may be obtained).

Toners produced in accordance with the present disclosure may possess excellent charging characteristics when exposed to extreme relative humidity (RH) conditions. The low-humidity zone (C zone) may be about 12° C./15% RH, while the high humidity zone (A zone) may be about 28° C./85% RH (although values outside of these ranges may be obtained). Toners of the present disclosure may possess a parent toner charge per mass ratio (Q/M) of from about −5 μC/g to about −80 μC/g, in embodiments from about −10 μC/g to about −70 μC/g, and a final toner charging after surface additive blending of from −15 μC/g to about −60 μC/g, in embodiments from about −20 μC/g to about −55 μC/g.

Developer

The toner particles may be formulated into a developer composition by combining them with the coated carriers of the present disclosure. For example, the toner particles may be mixed with the coated carrier particles to achieve a two-component developer composition. The carrier particles can be mixed with the toner particles in various suitable combinations. The toner concentration in the developer may be from about 1% to about 25% by weight of the developer, in embodiments from about 2% to about 15% by weight of the total weight of the developer, with the carrier present in an amount of from about 80% to about 96% by weight of the developer, in embodiments from about 85% to about 95% by weight of the developer (although values outside of these ranges may be used). In embodiments, the toner concentration may be from about 90% to about 98% by weight of the carrier (although values outside of these ranges may be used). However, different toner and carrier percentages may be used to achieve a developer composition with desired characteristics.

Thus, for example, there can be formulated in accordance with the present disclosure developers with resistivity as determined in a magnetic brush conducting cell of from about le ohm-cm to about $10^{14}$ ohm-cm at 10 Volts, in embodiments from about $10^{10}$ ohm-cm to about $10^{13}$ ohm-cm at 10 Volts, and from about $10^{8}$ ohm-cm to about $10^{13}$ ohm-cm at 150 Volts, in embodiments from about $10^{9}$ ohm-cm to about $10^{12}$ ohm-cm at 150 Volts.

Toners including the carriers of the present disclosure may thus have triboelectric charges of from about 15 μC/g to about 60 μC/g, in embodiments from about 20 μC/g to about 55 μC/g.

Resistivity

To measure carrier conductivity or resistivity, about 30 to about 50 grams of the carrier were placed between two circular planar parallel steel electrodes (radius=3 centimeters), and compressed by a weight of 4 kilograms to form an about 0.4 to about 0.5 centimeter layer; the DC voltage of 10 volts was applied between the electrodes, and a DC current was measured in series between the electrodes and voltage source after 1 minute following the moment of voltage application. Conductivity in $(\text{ohm cm})^{-1}$ was obtained by multiplying current in Amperes, by the layer thickness in centimeters, and divided by the electrode area in $cm^2$ and by the voltage, 10 volts. Resistivity is obtained as the inverse of the conductivity and is measured in ohm-cm. The voltage was increased to 150 volts and the measurement repeated, and the calculation done the same way, using the value of the voltage of 150 volts.

In accordance with the present disclosure, a carrier may have a resistivity of from about $10^9$ to about $10^{14}$ ohm-cm measured at 10 volts, and from about $10^8$ to about $10^{13}$ ohm-cm at 150 volts.

Imaging

The carrier particles of the present invention can be selected for a number of different imaging systems and devices, such as electrophotographic copiers and printers, inclusive of high speed color electrophotographic systems, printers, digital systems, combination of electrophotographic and digital systems, and wherein colored images with excellent and substantially no background deposits are achievable. Developer compositions including the carrier particles illustrated herein and prepared, for example, by a dry coating process may be useful in electrostatographic or electrophotographic imaging systems, especially electrophotographic imaging and printing processes, and digital processes. Additionally, the developer compositions of the present disclosure including the conductive carrier particles of the present disclosure may be useful in imaging methods wherein relatively constant conductivity parameters are desired. Furthermore, in the aforementioned imaging processes the toner triboelectric charge with the carrier particles can be preselected, which charge is dependent, for example, on the polymer composition applied to the carrier core, and optionally the type and amount of the conductive component selected.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C. (although temperatures outside of these ranges may be used), after or during melting onto the image receiving substrate.

Images, especially colored images obtained with the developer compositions of the present invention in embodiments possess, for example, acceptable solids, excellent halftones, and desirable line resolution with acceptable or substantially no background deposits, excellent chroma, superior color intensity, constant color chroma and intensity over extended time periods, such as 1,000,000 imaging cycles, and the like.

The following examples are being submitted to illustrate embodiments of the present disclosure. These examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Latex

A latex emulsion including polymer particles generated from the emulsion polymerization of a primary monomer and secondary monomer was prepared as follows. A surfactant solution including about 2.6 mmol sodium lauryl sulfate (an anionic emulsifier) and about 21 mole of de-ionized water was prepared by combining the two in a beaker and mixing for about 10 minutes. The aqueous surfactant solution was then transferred into a reactor. The reactor was continuously purged with nitrogen while being stirred at about 450 revolutions per minute (rpm).

Separately, about 2 mmol of ammonium persulfate initiator was dissolved in about 222 mmol of de-ionized water to form an initiator solution.

In a separate container, about a predetermined amount of primary monomer and a predetermined amount of secondary monomer, as described in Table 1 below, were combined. About 10 percent by weight of this solution was added to the aqueous surfactant mixture as a seed. The reactor was then heated up to about 65° C. at a controlled rate of about 1° C./minute. Once the temperature of the reactor reached about 65° C., the initiator solution was slowly charged into the reactor over a period of about 40 minutes, after which the rest of the emulsion was continuously fed into the reactor using a metering pump at a rate of about 0.8% by weight/minute. Once all the monomer emulsion was charged into the main reactor, the temperature was held at about 65° C. for an additional 2 hours to complete the reaction.

Full cooling was then applied and the reactor temperature was reduced to about 35° C. The product was then collected into a container and dried to a powder form using a freeze-drier. Six latexes were prepared following the above processes, with varying amounts of reactants. A summary of the reactants and the properties of the copolymers thus produced are summarized below in Table 1.

TABLE 1

Latex formulation and properties for carrier coating.

| Latex | Primary Monomer | Secondary Monomer | Primary Monomer (mmol) | Secondary Monomer (mmol) | mol. % Secondary Monomer | Size D50 (nm) | Mw | Mn | PDI | Tg |
|---|---|---|---|---|---|---|---|---|---|---|
| A | Methyl methacrylate | Methacrylic acid | 1906.7 | 22.4 | 1.175 | 76.0 | 439k | 169k | 2.6 | 125 |
| B | Cyclohexyl methacrylate | DMAEMA | 665.7 | 0.0 | 0.000 | 88.8 | 724k | 320k | 2.26 | 105 |
| C | Cyclohexyl methacrylate | DMAEMA | 665.7 | 1.8 | 0.270 | 91.7 | 468k | 25k | 18.9 | 104 |
| D | Cyclohexyl methacrylate | DMAEMA | 665.7 | 3.6 | 0.541 | 92.3 | 463k | 30k | 15.3 | 104 |
| E | Cyclohexyl methacrylate | DMAEMA | 665.7 | 7.2 | 1.082 | 105.0 | 484 | 105 | 4.62 | 104 |
| F | Cyclohexyl methacrylate | DMAEMA | 665.7 | 10.8 | 1.622 | 106.0 | 346k | 170k | 2.04 | 103 |

Comparative Examples 1-5 and Examples 1-7

A carrier was prepared as follows. About 120 grams of a 35 micron ferrite core (commercially available from Powdertech) was placed into a 250 ml polyethylene bottle. About 0.912 grams of the dried powder polymer latex as described in Table 2 was added thereto, as well as a predetermined amount of Cabot VULCAN XC72 Carbon Black (by weight of coating) as described in Table 2. The bottle was then sealed and loaded into a C-zone TURBULA mixer. The TURBULA mixer was run for about 45 minutes to disperse the powders onto the carrier core particles.

Next, a HAAKE mixer was setup with the following conditions: set temperature 200° C. (all zones); 30 minute batch time; 30 RPM with high shear rotors. After the Haake reached its operating temperature, the mixer rotation was started and the blend was transferred from the TURBULA into the HAAKE mixer. After about 45 minutes, the carrier was discharged from the mixer and sieved through a 45 μm screen. Twelve carriers were prepared following the above process. A summary of the carriers produced, including the coatings utilized and their amounts, are set forth below in Table 2.

TABLE 3-continued

Resistivity data at 10 Volts

| Carrier ID | Resistivity at 10 V (ohm * cm * 10^9) |
|---|---|
| Comparative Example 3 | 14021 |
| Comparative Example 4 | 12468 |
| Comparative Example 5 | 15390 |
| Example 1 | 11851 |
| Example 2 | 7453 |
| Example 3 | 91 |
| Example 4 | 77 |
| Example 5 | 418 |
| Example 6 | 10065 |
| Example 7 | 12978 |

TABLE 2

Carrier Formulation

| | Carrier ID | | | | | | | | | | | |
|---|---|---|---|---|---|---|---|---|---|---|---|---|
| | Comparative Example 1 | Comparative Example 2 | Comparative Example 3 | Comparative Example 4 | Comparative Example 5 | Example 1 | Example 2 | Example 3 | Example 4 | Example 5 | Example 6 | Example 7 |
| Latex | A | B | A | A | A | C | D | E | F | E | E | E |
| wt % Carbon Black | 5 | 5 | 0 | 7.5 | 10 | 5 | 5 | 5 | 5 | 0 | 7.5 | 10 |

A summary of coated carrier resistivity data is shown in Table 3 (at 10 volts) and Table 4 (at 150 volts) below.

TABLE 3

Resistivity data at 10 Volts

| Carrier ID | Resistivity at 10 V (ohm * cm * 10^9) |
|---|---|
| Comparative Example 2 | 8627 |

TABLE 4

Resistivity data at 150 Volts

| Carrier ID | Resistivity at 150 V (ohm * cm * 10^9) |
|---|---|
| Comparative Example 2 | 441 |
| Example 1 | 730 |
| Example 2 | 15 |

Developers were prepared with the various carriers listed in Table 2 by combining them with a Xerox 700 Digital Color Press cyan toner. The concentration of the toner was about 5 parts per hundred (pph). Developers were conditioned over night in A-zone and C-zone and then sealed and agitated for 60 minutes using a Turbula mixer.

Figure 2:
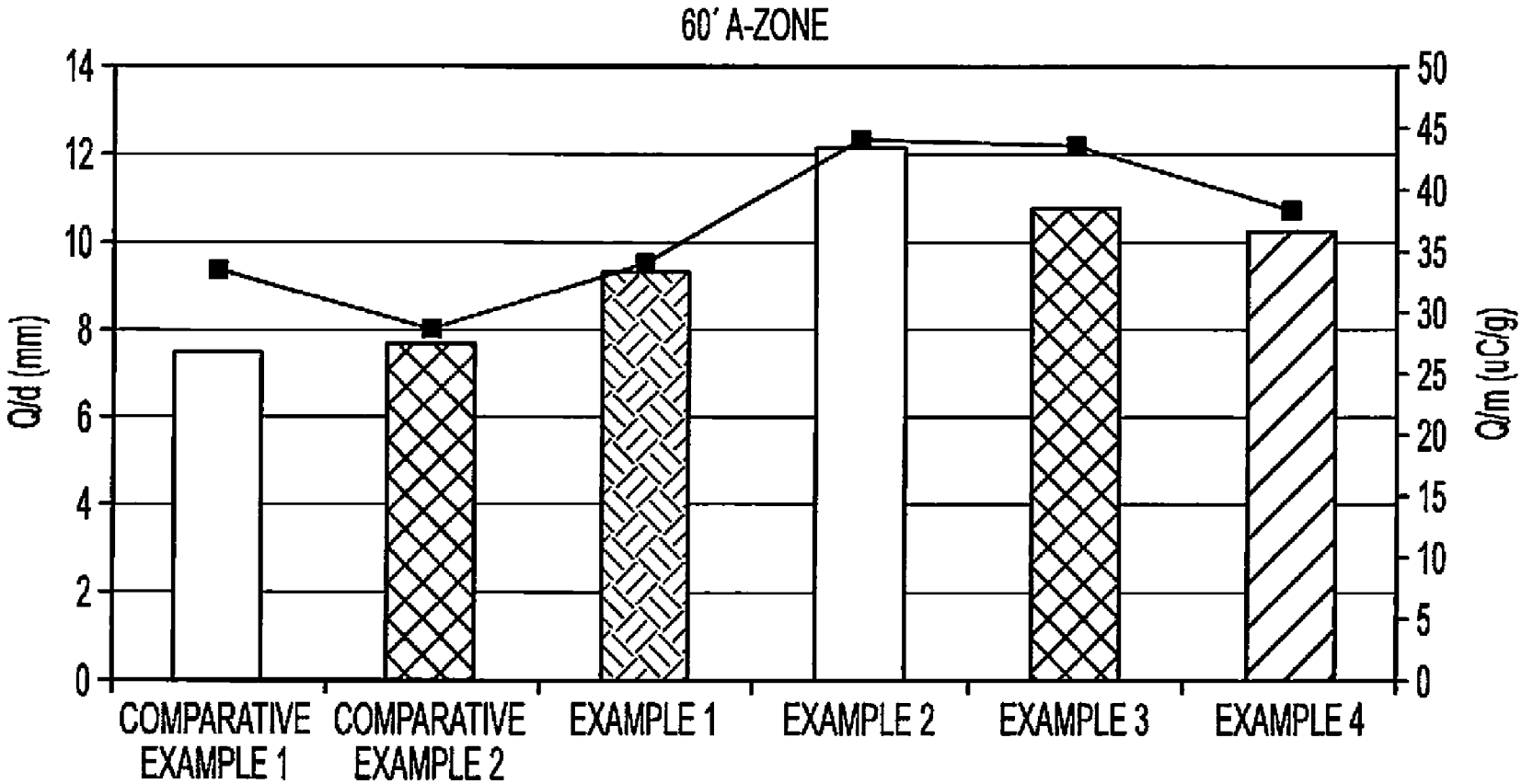
FIG. 2 is a graph showing the 60 minute A-zone charging characteristics for toners of the present disclosure.

Charging characteristics were obtained by a charge spectrograph using a 100 V/cm field. FIG. 1 provides a summary of the 60 minute C-zone charging characteristics for the various toners. As shown in FIG. 1, C-zone charge was trending upward with increasing amounts of 2-(dimethyl amino) ethyl methacrylate (DMAEMA) levels in the carrier coating. FIG. 2 provides a summary of the 60 minute A-zone charging characteristics for the various toners. As shown in FIG. 2, A-zone charging was also trending upward.

Figure 3:
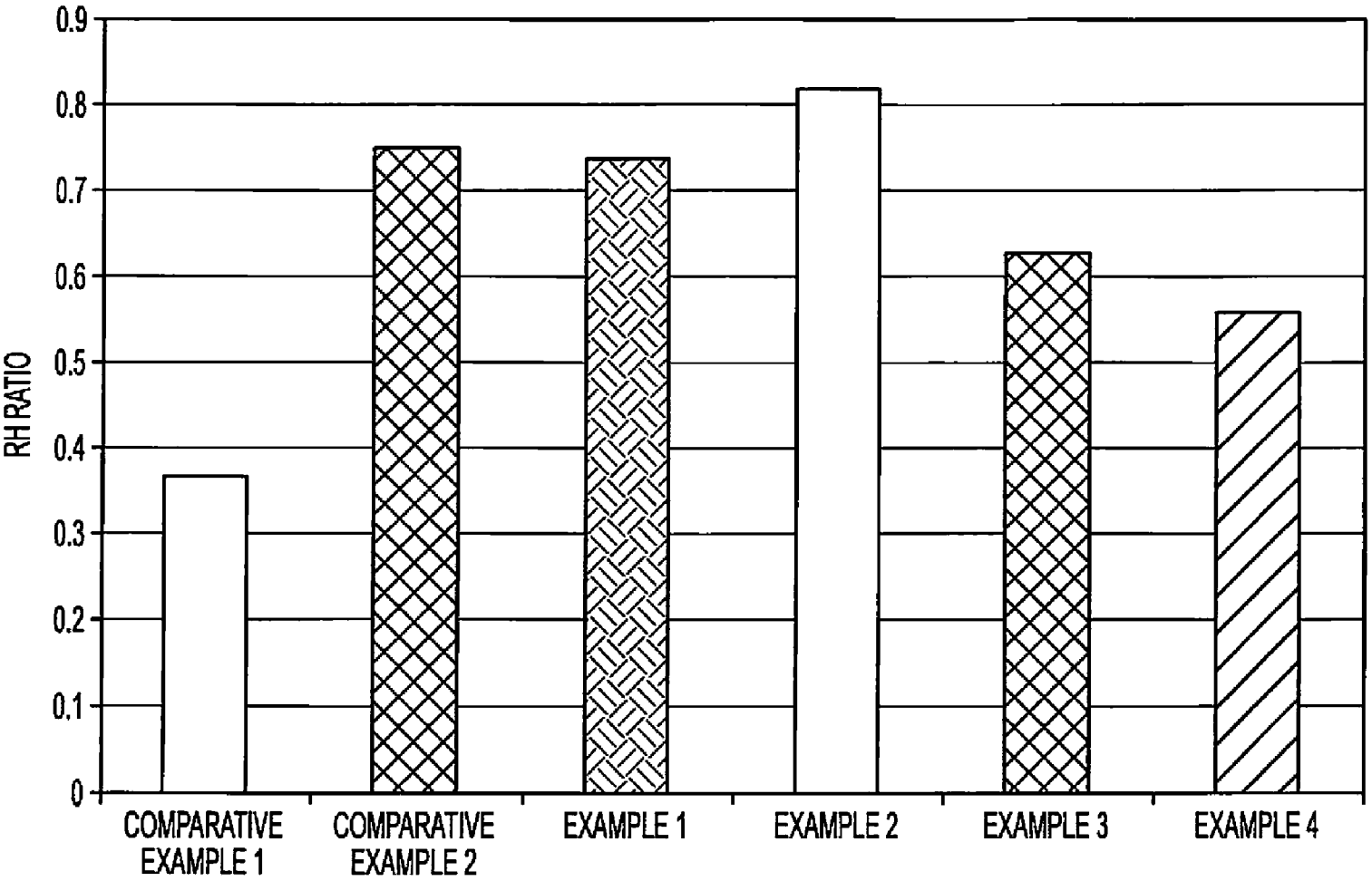
FIG. 3 is a graph showing the relative humidity (RH) ratio for 60 minute A-zone charging and C-zone charging (A/C) for toners of the present disclosure.

FIG. 3 provides a graph showing the relative humidity (RH) ratio for 60 minute A-zone charging and C-zone charging (A/C) for toner using various carriers. As shown in FIG. 3, the toner RH sensitivity for all the example powder coated carriers was better (higher A/C ratio) than the carrier of Comparative Example 1.

Figure 4:
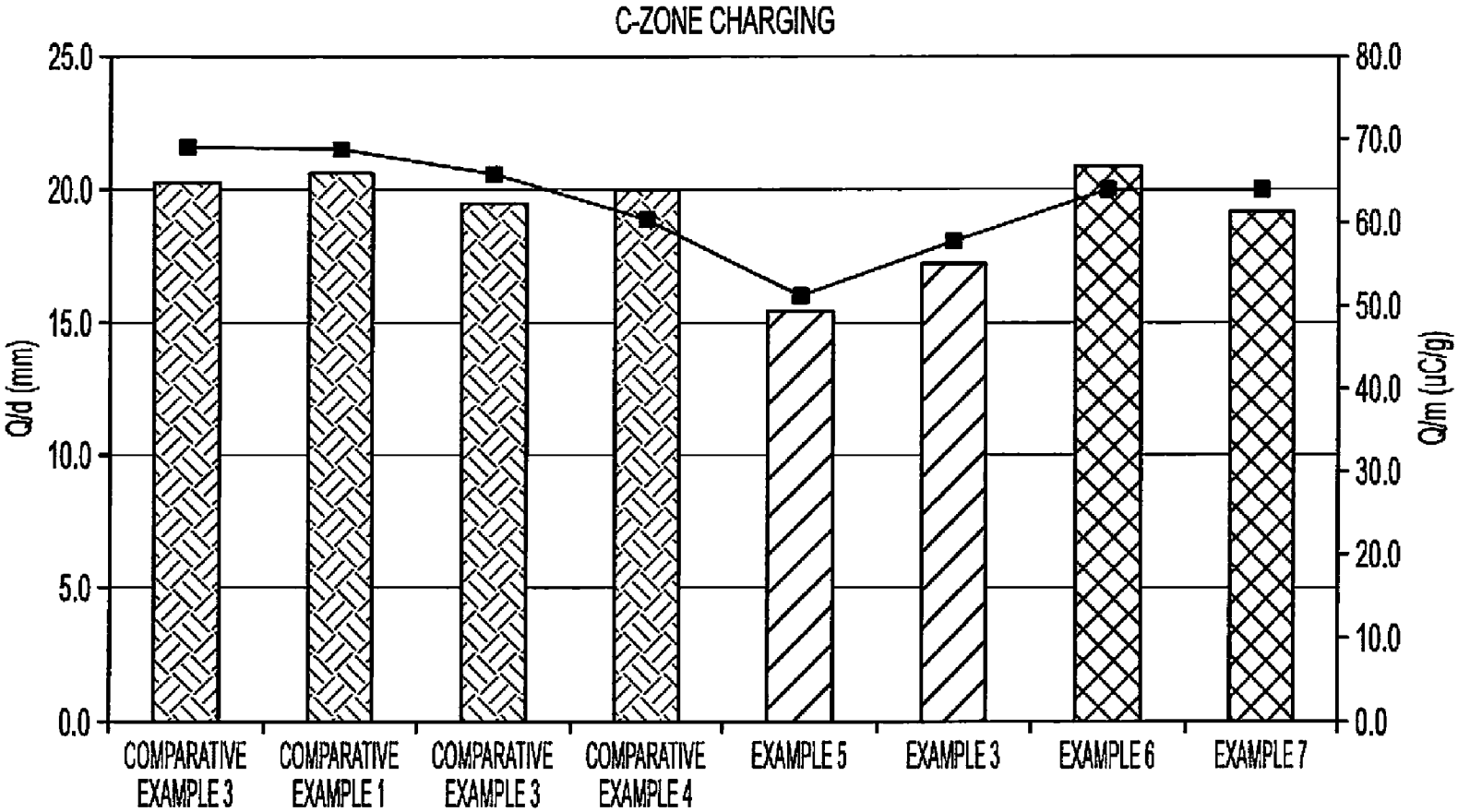
FIG. 4 is a graph showing the 60 minute C-zone toner charging for carriers of the present disclosure, including various amounts of carbon black, compared to a commercial carrier.

FIG. 4 is a graph showing the 60 minute C-zone toner charging for carriers including various amounts of carbon black compared to commercial carrier. The carriers on the right hand side of FIG. 4 showed increased toner charging with higher carbon black levels.

Figure 5:
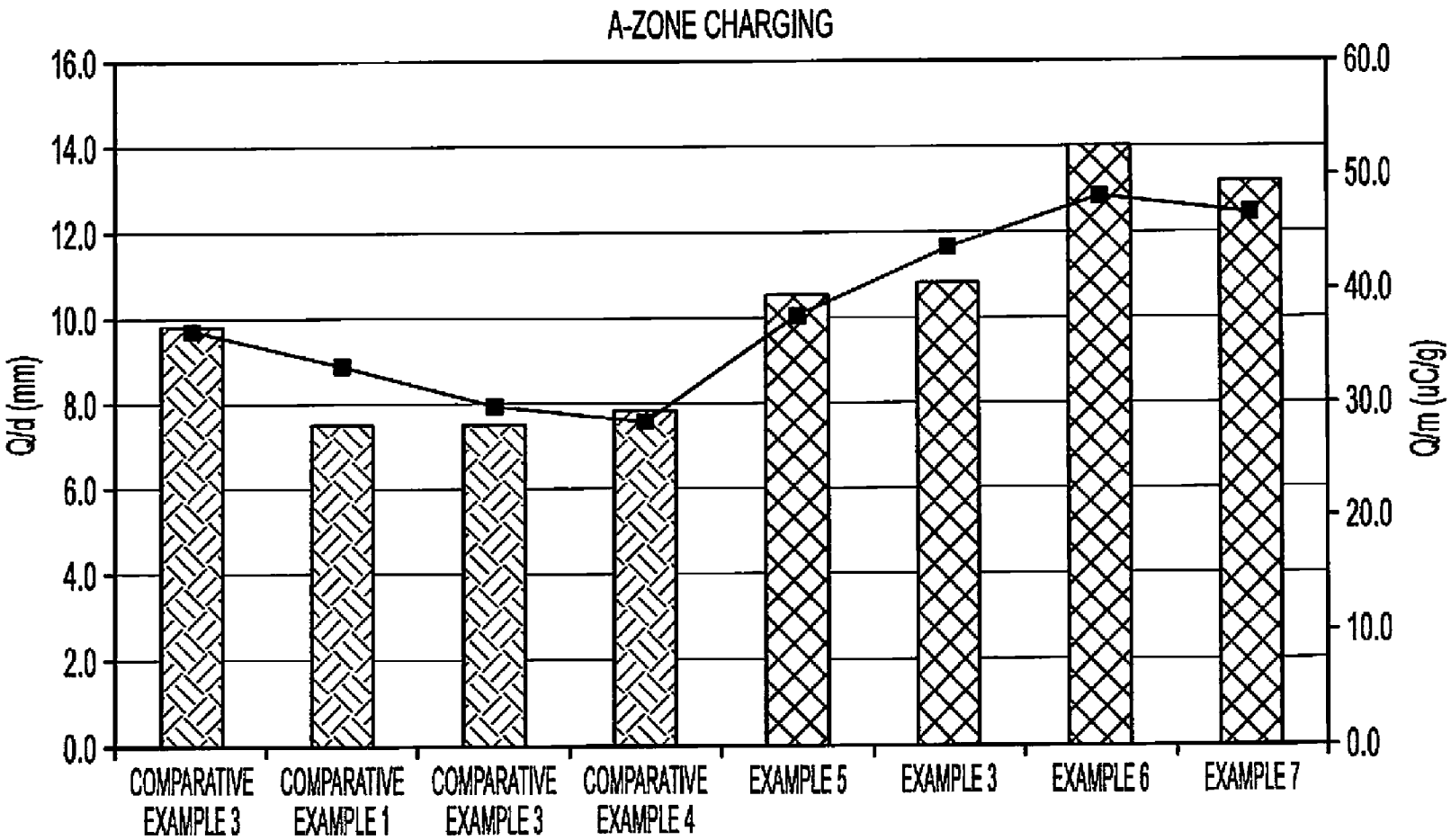
FIG. 5 is a graph showing 60 minute toner A-zone charging for carriers of the present disclosure, including various amounts of carbon black, compared to a commercial carrier.

FIG. 5 is a graph showing 60 minute A-zone toner charging for carriers containing various amounts of carbon black compared to a commercial carrier. The carriers on the right hand side of FIG. 5 showed increased toner charging with higher carbon black levels.

Figure 6:
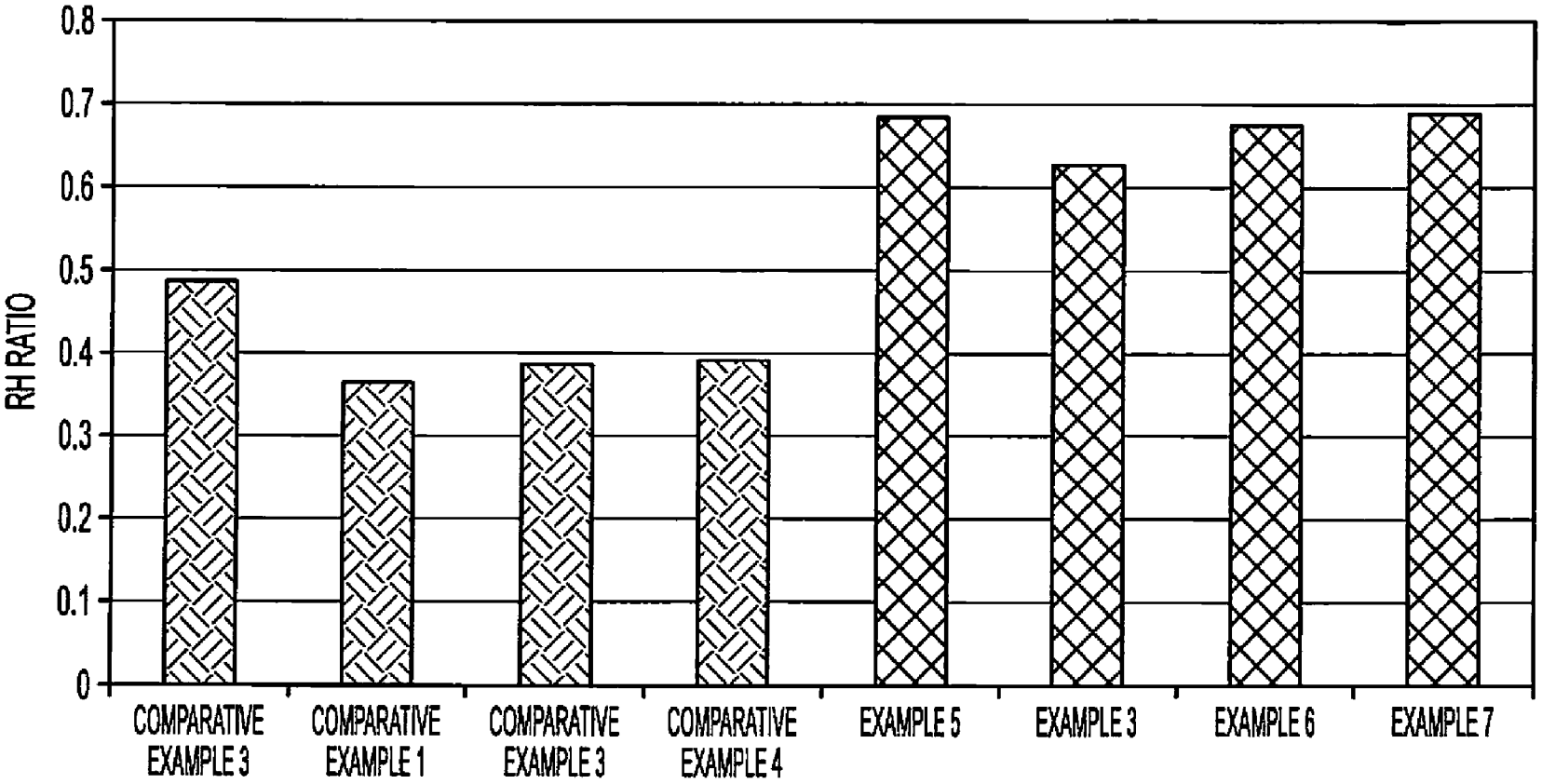
FIG. 6 is a graph showing the RH ratio for 60 minute A-zone toner charging and C-zone toner charging (A/C) for carriers of the present disclosure, including various amounts of carbon black, compared to commercial carriers.

FIG. 6 is a graph showing RH ratio for 60 minute A-zone toner charging and C-zone toner charging (A/C) for carriers containing various amounts of carbon black compared to commercial carriers. As can be seen in FIG. 6, there was no trend observed for RH with carbon black loading.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A carrier comprising: a core; and a polymeric coating over at least a portion of a surface of the core, the polymeric coating comprising a copolymer containing monomers comprising an aliphatic cycloacrylate and a dialklyaminoacrylate, and optionally carbon black, wherein the polymeric resin coating is fused to the surface of the carrier core by heating, wherein the polymeric coating has a weight average molecular weight of from about 200,000 to about 800,000 and wherein said dialkylaminoacrylate comprises from about 0.01% to about 5% by weight of the copolymer.

2. The carrier as in claim 1, wherein the core is selected from the group consisting of iron, steel, ferrites, magnetites, nickel, and combinations thereof, having an average particle size of from about 20 microns to about 400 microns in diameter, and wherein the coating comprises the copolymer in combination with carbon black.

3. The carrier as in claim 1, wherein the core comprises a ferrite including iron and at least one additional metal selected from the group consisting of copper, zinc, nickel, manganese, magnesium, calcium, lithium, strontium, barium zirconium, titanium, tantalum, bismuth, sodium, potassium, rubidium, cesium, strontium, barium, yttrium, lanthanum, hafnium, vanadium, niobium, aluminum, gallium, silicon, germanium, antimony and bismuth and combinations thereof.

4. The carrier as in claim 1, wherein the aliphatic cycloacrylate is selected from the group consisting of cyclohexylmethacrylate, cyclopropyl acrylate, cyclobutyl acrylate, cyclopentyl acrylate, cyclohexyl acrylate, cyclopropyl methacrylate, cyclobutyl methacrylate, cyclopentyl methacrylate, and combinations thereof, and wherein the dialklyaminoacrylate is selected from the group consisting of dimethylamino ethyl methacrylate, 2-(dimethylamino) ethyl methacrylate, diethylamino ethyl methacrylate, 2-(dimethylamino) ethyl methacrylate, diethylamino ethyl methacrylate, dimethylamino butyl methacrylate, methylamino ethyl methacrylate, and combinations thereof.

5. The carrier as in claim 1, where the dialklyaminoacylate is selected from the group consisting of dimethylamino ethyl methacrylate, 2-(dimethylamino) ethyl methacrylate, diethylamino ethyl methacrylate, 2-(dimethylamino) ethyl methacrylate, diethylamino ethyl methacrylate, dimethylamino butyl methacrylate, methylamino ethyl methacrylate, and combinations thereof.

6. The carrier as in claim 1, wherein the polymeric coating has a number average molecular weight of from about 60,000 to about 400,000 and a glass transition temperature of from about 85° C. to about 140° C.

7. The carrier as in claim 1, wherein the coated carrier has a resistivity of from about $10^9$ ohm-cm to about $10^{14}$ ohm-cm measured at 10 volts, and from about $10^8$ to about $10^{13}$ ohm-cm at 150 volts.

8. A developer composition comprising: a toner comprising at least one resin and one or more optional ingredients selected from the group consisting of optional colorants, optional waxes, and combinations thereof; and the carrier of claim 1.

9. The composition as in claim 8, wherein the developer has a triboelectric charge of from about 15 μC/g to about 60 μC/g.

10. The composition as in claim 8, wherein the toner comprises at least one amorphous resin in combination with at least one crystalline resin.

11. The composition as in claim 10, wherein the at least one amorphous resin comprises a polyester, and wherein the at least one crystalline resin comprises a polyester.

12. The composition as in claim 8, wherein the core is selected from the group consisting of iron, steel, copper/zinc-ferrites, nickel/zinc-ferrites, strontium-ferrites, magnetites, nickel, and combinations thereof, having an average particle size of from about 20 microns to about 400 microns in diameter, and wherein the coating comprises the copolymer in combination with carbon black.

13. The composition as in claim 8, wherein the core comprises a ferrite including iron and at least one additional metal selected from the group consisting of copper, zinc, nickel, manganese, magnesium, calcium, lithium, strontium, barium zirconium, titanium, tantalum, bismuth, sodium, potassium, rubidium, cesium, strontium, barium, yttrium, lanthanum, hafnium, vanadium, niobium, aluminum, gallium, silicon, germanium, antimony and bismuth and combinations of metals thereof.

14. The composition as in claim 8, wherein the aliphatic cycloacrylate is selected from the group consisting of cyclohexylmethacrylate, cyclopropyl acrylate, cyclobutyl acrylate, cyclopentyl acrylate, cyclohexyl acrylate, cyclopropyl methacrylate, cyclobutyl methacrylate, cyclopentyl methacrylate, and combinations thereof, and wherein the dialklyaminoacrylate is selected from the group consisting of dimethylamino ethyl methacrylate, 2-(dimethylamino) ethyl methacrylate, diethylamino ethyl methacrylate, 2-(dimethylamino) ethyl methacrylate, diethylamino ethyl methacrylate, dimethylamino butyl methacrylate, methylamino ethyl methacrylate, and combinations thereof.

15. The composition as in claim 8, wherein the polymeric coating has a number average molecular weight of from about 60,000 to about 400,000, and a glass transition temperature of from about 85° C. to about 140° C.

16. A process for preparing the carrier of claim 1, comprising: forming an emulsion comprising at least one surfactant, an aliphatic cycloacrylate, a dialklyaminoacrylate, and optionally carbon black; polymerizing the aliphatic cycloacrylate and the dialklyaminoacrylate to form a copolymer resin; recovering the copolymer resin; drying the copolymer resin to form a powder coating; and applying the powder coating to the core.

17. The process as in claim 16, wherein the aliphatic cycloacrylate is selected from the group consisting of cyclohexylmethacrylate, cyclopropyl acrylate, cyclobutyl acrylate, cyclopentyl acrylate, cyclohexyl acrylate, cyclopropyl methacrylate, cyclobutyl methacrylate, cyclopentyl methacrylate, and combinations thereof, and wherein the dialklyaminoacrylate is selected from the group consisting of dimethylamino ethyl methacrylate, 2-(dimethylamino) ethyl methacrylate, diethylamino ethyl methacrylate, 2-(dimethylamino) ethyl methacrylate, diethylamino ethyl methacrylate, dimethylamino butyl methacrylate, methylamino ethyl methacrylate, and combinations thereof, and wherein the core is selected from the group consisting of iron, steel, ferrites, magnetites, nickel, and combinations thereof, having an average particle size of from about 20 microns to about 400 microns in diameter.

18. The process as in claim 16, wherein the polymeric coating comprises a polycyclomethacrylate-co-2-(dimethyl amino)ethylmethacrylate copolymer, and wherein the core comprises a ferrite selected from the group consisting of copper/zinc-ferrites, nickel/zinc-ferrites, strontium-ferrites, and combinations thereof.

19. The process as in claim 16, wherein the polymeric coating has a number average molecular weight of from about 60,000 to about 400,000, and a glass transition temperature of from about 85° C. to about 140° C., and wherein the coating comprises the copolymer in combination with carbon black.

20. The process as in claim 16, wherein applying the powder coating to the core occurs by a process selected from the group consisting of cascade roll mixing, tumbling, milling, shaking, electrostatic powder cloud spraying, fluidized bed, electrostatic disc processing, electrostatic curtains, and combinations thereof.

* * * * *